US006003000A

United States Patent [19]

Ozzimo et al.

[11] Patent Number: 6,003,000

[45] **Date of Patent: *Dec. 14, 1999**

[54] METHOD AND SYSTEM FOR SPEECH PROCESSING WITH GREATLY REDUCED HARMONIC AND INTERMODULATION DISTORTION

[75] Inventors: Michele L. Ozzimo, Atlanta, Ga.; Matthew C. Cobb, Melbourne Beach, Fla.; James A. Dinnan, Athens, Ga.

[73] Assignee: Meta-C Corporation, Athens, Ga.

[ * ] Notice: This patent issued on a continued prosecution application filed under 37 CFR 1.53(d), and is subject to the twenty year patent term provisions of 35 U.S.C. 154(a)(2).

[21] Appl. No.: 08/848,637

[22] Filed: Apr. 29, 1997

[51] Int. Cl.[6] ..... G10L 3/02

[52] U.S. Cl. ..... 704/219; 704/205; 704/209; 704/220

[58] Field of Search ..... 704/261, 262, 704/219, 230, 209, 205, 220

[56] References Cited

U.S. PATENT DOCUMENTS

| | | | |
|---|---|---|---|
| 3,624,302 | 11/1971 | Atal | 179/1 SA |
| 3,947,636 | 3/1976 | Edgar | 179/1 P |
| 4,184,049 | 1/1980 | Crochiere et al. | 704/230 |
| 4,283,601 | 8/1981 | Nakajima et al. | 179/1 SD |
| 4,472,832 | 9/1984 | Atal et al. | 381/40 |
| 4,860,624 | 8/1989 | Dinnan et al. | 84/1.01 |
| 5,029,211 | 7/1991 | Ozawa | 704/258 |
| 5,105,464 | 4/1992 | Zinser | 381/38 |
| 5,306,865 | 4/1994 | Dinnan et al. | 84/622 |
| 5,361,324 | 11/1994 | Takizawa et al. | 704/268 |
| 5,583,961 | 12/1996 | Pawlewski et al. | 704/241 |
| 5,715,362 | 2/1998 | Vanska | 704/261 |
| 5,750,912 | 5/1998 | Matsumoto | 704/261 |

OTHER PUBLICATIONS

Atal et al., "A New Model of LPC Excitation for Producing Natural Sounding Speech at Low Bit Rates," *Proc. of 1982* IEEE Int. Conf. on Acoustics, Speech, and Signal Processing, May 1982 pp. 614–617.

Rabiner, L.R., and Schafer, R.W., *Digital Processing of Speech Signals,* Prentice Hall, New Jersey, 1978.

Rabiner, L.R. and Juang, Biing–Hwang, *Fundamentals of Speech Recognition,* Prentice Hall, 1993.

Quatieri, T. and McAulay, R., "Phase Coherence in Speech Reconstruction for Enhancement and Coding Applications," *Proc. of 1989 IEEE Int. Conf. on Acoustics, Speech and Signal Processing,* May 1989, pp. 207–209.

Schroeder et al., "Code Excited Linear Production (CELP): High Quality Speech at Very Low Bit Rates," *Proc. of 1985 IEEE Int. Conf. on Acoustics, Speech and Signal Processing*, Mar., 1985, pp. 937–940.

Sreenivas, "Modeling LPC Residue by Components for Good Quality Speech Coding," *Proc. of 1988 IEEE Int. Conf. on Acoustics, Speech and Signal Processing,* Apr. 1988, pp. 171–174.

Tomasi, Wayne, and Alisouskas, Vincent, *Telecommunications Voice/Data with Fiber Optic Applications,* Prentice Hall, 1988.

*Primary Examiner*—David R. Hudspeth
*Assistant Examiner*—Daniel Abebe
*Attorney, Agent, or Firm*—Sughrue, Mion, Zinn, Macpeak & Seas, PLLC

[57] ABSTRACT

A method and system for representing speech with greatly reduced harmonic and intermodulation distortion using a fixed interval scale, known as Tru-Scale. Speech is reproduced in accordance with a frequency matrix which reduces intermodulation interference and harmonic distortion (overtone collision). Enhanced speech quality and reduced noise results from increasing the signal-to-noise ratio in the processed speech signal. The method and system use an Auto-Regressive (AR) modeling technique, using, among other approaches, Linear Predictive Coding (LPC) analysis. In accordance with another aspect of the invention, a Fourier transform-based modeling technique also is used. The application of the system to speech coders also is contemplated.

23 Claims, 6 Drawing Sheets

(2 of 6 Drawing Sheet(s) Filed in Color)

METHOD AND SYSTEM FOR SPEECH PROCESSING WITH GREATLY REDUCED HARMONIC AND INTERMODULATION DISTORTION

BACKGROUND OF THE INVENTION

The present system relates to a new technique for reducing harmonic distortion in the reproduction of voice signals, and to a novel method of reducing overtone collisions resulting from current methods of voice representation. The invention is based on a wave system of communication which relies on a different basis of periodicity in wave propagation and a fixed interval frequency matrix, called "Tru-Scale," as outlined in U.S. Pat. Nos. 4,860,624 and 5,306,865. More particularly, the system employs the Tru-Scale interval system with Auto-Regressive speech modeling techniques to remove these overtone collisions. The invention enhances speech quality and reduces noise in the resulting speech signal.

During speech production, the vocal folds open and close, thereby distinguishing speech into two categories, called voiced and unvoiced. During voiced speech, the vocal folds are normally closed, causing them to vibrate from the passage of air. The frequency of this vibration is assigned to the speaker's pitch frequency; for normal speakers, the frequency is in the range of 50 to 400 Hz.

Therefore, a voiced signal begins as a series of pulses, whereas an unvoiced signal begins as random noise. The vibrating vocal chords give a speech signal its periodic properties. The pitch frequency and its harmonics impress a spectral structure in the spectrum of the voiced signal. The rest of the vocal tract acts as a spectral shaping filter to the aforementioned speech spectrum.

In voiced sounds, the vocal tract also acts as a resonant cavity. This resonance produces large peaks in the resulting speech spectrum. These peaks are known as formants, and contain a majority of the information in the speech signal. In particular, formants are, among other things, what distinguish one speaker's voice from another's. Using this fact, the vocal tract can be modeled using an all-pole linear system. Speech coding based on modeling of the vocal tract, using techniques such as Auto-Regressive (AR) modeling and Linear Predictive Coding (LPC), takes advantage of the inherent characteristics of speech production. The AR model assumes that speech is produced by exciting a linear system—the vocal tract—by either a series of periodic pulses (if the sound is voiced) or noise (if it is unvoiced).

For many applications, the goal of speech modeling is to encode an analog speech signal into a compressed digital format, transmit or store the digital signal, and then decode the digital signal back into analog form. Several implementations of AR modeling are commonly known within the art of speech compression. One of the major issues of current compression and modeling techniques, and their implementation into vocoders, is a reduction of speech quality.

These models typically estimate vocal tract shape and vocal tract excitation. If the speech is unvoiced, the excitation is a random noise sequence. If the speech is voiced, the excitation consists of a periodic series of impulses, the distance between these pulses equaling the pitch period. Current modeling techniques attempt to maintain the pitch period without regard to preventing overtone collisions or minimizing harmonic distortion. The result is poor speech quality and noise within the signal. Various attempts have been made to improve speech quality and reduce noise in the AR modeling system. Some of these will now be discussed.

One well known digital speech coding system, taught in U.S. Pat. No. 3,624,302, outlines linear prediction analysis of an input speech signal. The speech signal is modeled by forming the linear prediction coefficients that represent the spectral envelope of the speech signal, and the pitch and voicing signals corresponding to the speech excitation. The excitation pulses are modified by the spectral envelope representative prediction coefficients in an all pole predictive filter. However, the aforementioned speech coding system is discussed in U.S. Pat. No. 4,472,832, as follows:

> The foregoing pitch excited linear predictive coding is very efficient. The produced speech replica, however, exhibits a synthetic quality that is often difficult to understand. Errors in the pitch code . . . cause the speech replica to sound disturbed or unnatural.

Another well known example of attempts to improve speech quality within an LPC model is described by B. S. Atal and J. R. Remde in "A New Model of LPC Excitation for Producing Natural Sounding Speech at Low Bit Rates," *Proc. of* 1982 *IEEE Int. Conf. on Acoustics, Speech, and Signal Processing,* May 1982, pp. 614–617. The paper notes the following:

> The vocoders are efficient at reducing the bit rate to much lower values but do so only at the cost of lower speech quality and intelligibility . . . it is difficult to produce high-quality speech with this model, even at high bit rates.

U.S. Pat. No. 5,105,464 teaches that in recent attempts to improve on the Atal speech enhancement technique, "a pitch predictor is frequently added to the multi-pulse coder to further improve the SNR [signal to noise ratio] and speech quality." The patent goes on to describe the following:

> In any given speech coding algorithm, it is desirable to attain the maximum possible SNR in order to achieve the best speech quality. In general, to increase the SNR for a given algorithm, additional information must be transmitted to the receiver, resulting in a higher transmission rate. Thus, a simple modification to an existing algorithm that increases the SNR without increasing the transmission rate is a highly desirable result.

Thus, there has been clear recognition in the prior art that no AR modeling technique by itself has been known which completely overcomes poor speech quality. As will be discussed, in accordance with the present invention, the frequency matrix known as "Tru-Scale" and outlined in U.S. Pat. Nos. 4,860,624 and 5,306,865, is applied to a speech reproduction model to improve speech quality by removing harmonic distortion caused by current pitch assignments. By calculating pitch frequency using a new base, the Tru-Scale frequency matrix and corresponding ratios can eliminate the mathematical error in pitch code assignment. A reduction in harmonic distortion (decrease in the number of overtone collisions) increases the amount of signal to noise ratio of any given input signal, thereby enhancing speech quality by a novel method without increasing transmission rates.

The amount of noise in a speech signal affects speech quality by reducing the SNR. Noise can be generally defined as any undesired energy present in the usable passband of a communications system. Correlated noise is unwanted energy which is present as a direct result of the signal, and therefore implies a relationship between the signal and the noise. Nonlinear distortion, a type of correlated noise, is noise in the form of additional tones present because of the nonlinear amplification of a signal during transmission.

Noise in the form of nonlinear distortion can be divided into two classifications: harmonic distortion and intermodulation distortion. Harmonic distortion is the presence of unwanted multiples of the transmitted frequencies. In a music context, in which Tru-Scale first was introduced in the above-mentioned patents (those patents also disclosing tone generation using Tru-Scale), harmonic distortion sometimes is referred to as "overtone collision," a term which the inventors of the above-mentioned patents have used. Intermodulation distortion is the sums and differences of the input frequencies. Both of these distortions, if of sufficient amplitude, are found in speech transmissions and can cause serious signal degradation.

The reduction of noise in a speech signal that has been transmitted across a transmission medium is a well-known problem. U.S. Pat. No. 4,283,601 teaches the following:

> The input speech having passed through the network in this manner is distorted under the influence of the transmission characteristic of the transmission system. It is therefore necessary to eliminate the influence of the distortion or to reduce it by normalization or by other means if accurate speech recognition is to be obtained.

In an attempt to remove noise by a prior frequency filtering process, U.S. Pat. No. 3,947,636 discloses the following dilemma:

> Frequency filtration systems remove predetermined frequency ranges under the assumption that the eliminated frequencies contain relatively more noise and less signal than the nonfiltered frequencies. While this assumption may be valid in general as to those frequencies filtered, these systems do not even attempt to remove the components of the noise lying within the non-filtered frequencies nor do they attempt to salvage any program signal from the filtered frequencies. In effect, these systems muffle the noise and also part of the program.
>
> the primary disadvantage remains that not all of the components of the noise pulse are effectively filtered or removed, and not all of the signal is passed. The result is still a discernible noise coupled with a loss of signal quality.

The inventive system reduces noise and distortion within the speech signal using a novel approach without the above noted filtration systems. The Tru-Scale Interval system, when applied to the frequency component of a speech signal, reduces the destructive effects of harmonic distortion, or overtone collisions, from that signal. By realigning the spectral content, the harmonics of the transmitted frequencies travel in a way that reinforces the strength of the signal, rather than causing distortion. Using any modeling techniques, Tru-Scale is able to improve the signal to noise ratio of a transmitted speech signal, and therefore also improve the vocal quality. While earlier attempts have tried to improve the AR techniques or filter the noise, the invention improves the quality of the signal by making it less prone to intermodulation and harmonic distortion, thereby adding the improvement to the signal itself during the modeling and transmission process.

SUMMARY OF THE INVENTION

In view of the foregoing, one of the objects of the present invention is to provide a vocal tract modeling technique for speech reproduction that incorporates the frequency octave system and resultant ratio sequence known as Tru-Scale in which the above described disadvantages have been overcome.

The present invention accomplishes what previous efforts have failed to achieve. According to the invention, there is provided a voice reproduction system which incorporates a predetermined set of assigned frequencies in an octave which allows complete freedom of modulation and reduces harmonic distortion. The means and method for voice reproduction is an Auto Regressive model of the vocal tract. The set of frequency relationships is called Tru-Scale. With this novel approach to speech reproduction, all the advantages of speech coding, such as ease of transmission, are combined with a reduction of harmonic distortion to produce superior voice quality.

The application of the prior art to voice reproduction models improves speech quality by removing noise and distortion. AR modeling measures the overall spectral shape, or envelope, to create a linear image of the voice's spectrum. The AR model also maintains the correct amplitudes over their associated frequencies, which holds the formants in their correct positions. Using this technique, the pitch of the voice can be altered to reflect the Tru-Scale system while maintaining the relative placement of the formants, thereby increasing speech quality while allowing the voice to retain its speaker's identity.

In accordance with another aspect of the invention, a voice reproduction system is provided using Fourier transforms. The system in accordance with this aspect of the invention uses an analysis stage to determine the frequency content of the input voice signal, and a synthesis stage to reproduce those frequencies as the representation of the vocal tract. The length of the Fourier transform (Fast Fourier transform, or FFT) can be chosen to reproduce only those frequencies present in the Tru-Scale system.

In the present production of voice, the speaker's vibrational pitch is assigned a specific frequency that is represented in the model's parameters. It is important to note that the pitch and formant assignments are determined by mathematical computations and passed directly to the compression algorithm. Rather than attempting to preserve the original frequency assignment, with its inherent distortions, the Tru-Scale system alters the pitch in a way that improves speech quality.

The overall effect of the Tru-Scale frequency matrix is to make the voice signal more periodic and to create a much cleaner and stronger sounding voice reproduction, thereby increasing voice quality. Noise treated in the Tru-Scale process is transmitted as constructive interference that reinforces the signal's integrity, reducing nonlinear distortion across the signal transmission. The mathematical foundation behind the Tru-Scale system can also be used to enhance all forms of voice production, transmission, and reception.

The improved signals resulting from application of the inventive technique will enhance the performance and efficiency of current vocoders. The effects of Tru-Scale described herein are easily employed within the modeling phase of current vocoders. In addition, the Tru-Scale system can improve the resulting speech quality of all vocoders by reducing noise and harmonic distortion by either processing the input signal or as a post-processing method.

BRIEF DESCRIPTION OF THE DRAWINGS

The file of this patent contains at least one drawing executed in color. Copies of this patent with color drawings will be provided by the Patent and Trademark Office upon request and payment of the necessary fee.

A detailed description of a preferred embodiment of the invention now will be provided with reference to the accompanying drawings, in which.

DETAILED DESCRIPTION OF THE PREFERRED EMBODIMENTS

Figure 1A:
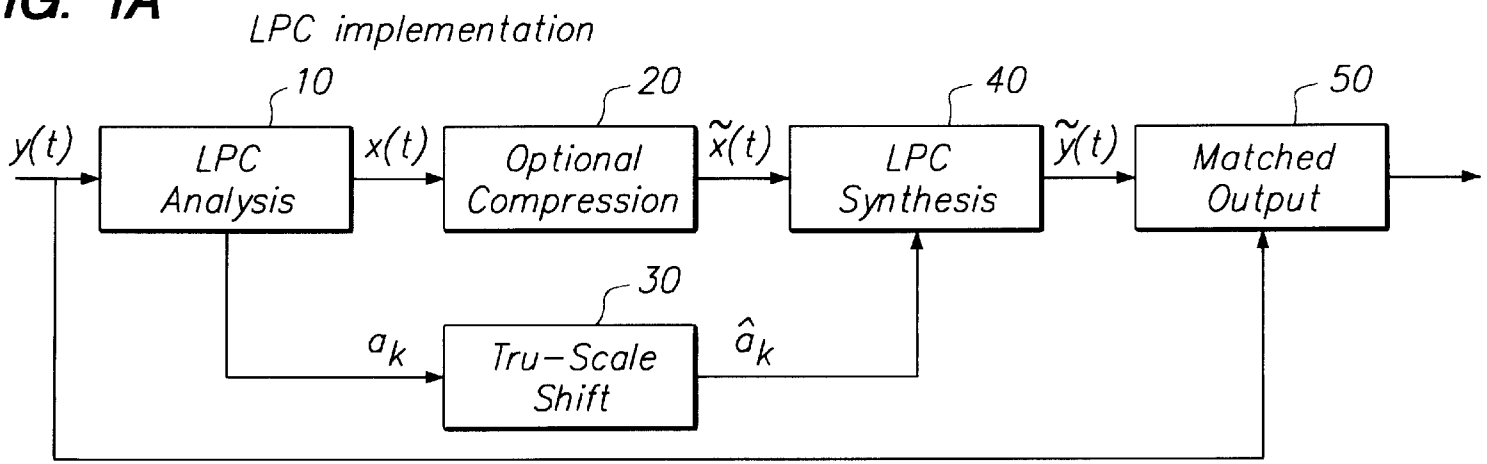
FIG. 1A is a block diagram of an AR modeling technique according to the present invention.

FIG. 1A indicates the data path used by the inventors to implement an Auto-Regressive (AR) method, particularly Linear Prediction Coding, of a Tru-Scale frequency shift. The analysis block 10 models the incoming speech as an auto-regressive signal, producing coefficients, $a_k$, which satisfy the equation $$y(t)=\Sigma a_k y(n-k)+x(t)$$

Here y(t) represents the original speech signal, and the coefficients $a_k$ express the spectral shaping due primarily to the speaker's vocal tract. The inventors prefer calculating these coefficients to satisfy the maximum-likelihood constraint, though other Linear Prediction based techniques are acceptable. Once the coefficients have been determined, the above equation may be used to solve for x(t), the vocal tract excitation. The accuracy of the model parameters over time may be judged by certain characteristics of x(t), such as peak magnitude and bandwidth. When the accuracy of the model parameters fail (as the speech phonemes change), the coefficients are recalculated.

Figure 2:
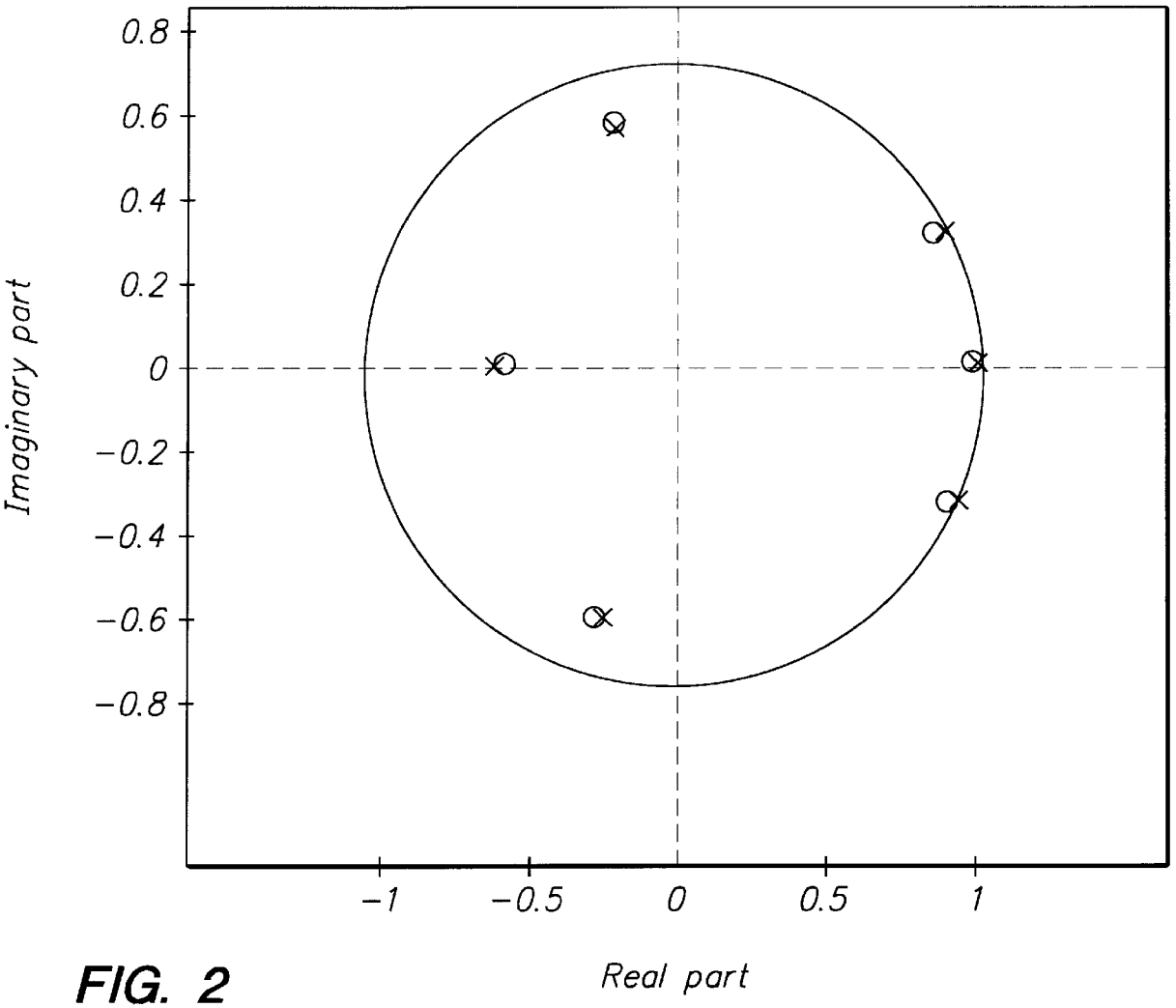
FIG. 2 is a unit circle showing the coefficients of the AR model as represented by the poles. The zeros represent the original poles, and the x's represent the poles shifted to Tru-Scale values.

The Tru-Scale shift from FIG. 1A is illustrated in FIG. 2 by representing the coefficients $a_k$ as poles on the unit circle. Here the poles defined by $a_k$ are represented by zeros, and the poles defined by $a_k$, shifted to Tru-Scale values, are represented by x's. In order to eliminate intermodulation and harmonic distortion, the coefficients $a_k$, defining the original formant frequencies, must be shifted to match the Tru-Scale frequency matrix. To implement the shifting process, the characteristic equation $$A(z) = 1 - \Sigma a_k z^{-k}$$

must be factored to find complex poles (roots of the characteristic equation). Each pole, $p_i$, can be interpreted as a formant frequency according to the following equation:

$$f_i = angle(p_i) \times \frac{f_s}{2\pi}$$

where $f_s$ is the sampling rate of the speech signal. The frequencies are then shifted according to the Tru-Scale frequency matrix (see block 20 in FIG. 1A, and Table 1 below). The characteristic equation may then be reformed by using the inverse of the above equation:

$$angle(\tilde{p}_i) = f_i \times \frac{2\pi}{f_s}$$

and multiplying the new roots to form a new characteristic equation:

$$\tilde{A}(z) = \frac{1}{(z-\tilde{p}_1)(z-\tilde{p}_2)\ldots} = 1 - \Sigma \hat{a}_k z^{-k}$$

These new coefficients $\hat{a}_k$, are used in synthesis stage 40 of FIG. 1A to produce an enhanced version of the original signal y(t):

$$y(t) = \Sigma \hat{a}_k y(n-k) + x(t)$$

The modeled vocal tract excitation, x(t), is shaped by the new coefficients to produce Tru-Scale quality speech. Any compressed version of x(t) or of the new coefficients may also be used in the synthesis stage; hence the inclusion of block 20 in FIG. 1A.

The final stage is a matched output control block 50, which is necessary because of the nature of auto-regressive signals. The output signal is limited in magnitude according to the input signal. Of many acceptable methods, the inventors prefer to use a two point exponential limiter.

Hardware and any associated software for performing AR modeling techniques for speech reproduction purposes are well known, and is contemplated within the individual blocks of FIG. 1A. The shifting of the equation coefficients using Tru-Scale, as shown in Table I for purposes of mapping the frequencies to Tru-Scale values, is described herein.

The AR techniques with which the present invention is intended to operate are not limited to LPC. In addition, among others, the invention works with mixed excitation linear prediction (MELP), code excited linear prediction (CELP), and pronys.

Figure 1B:
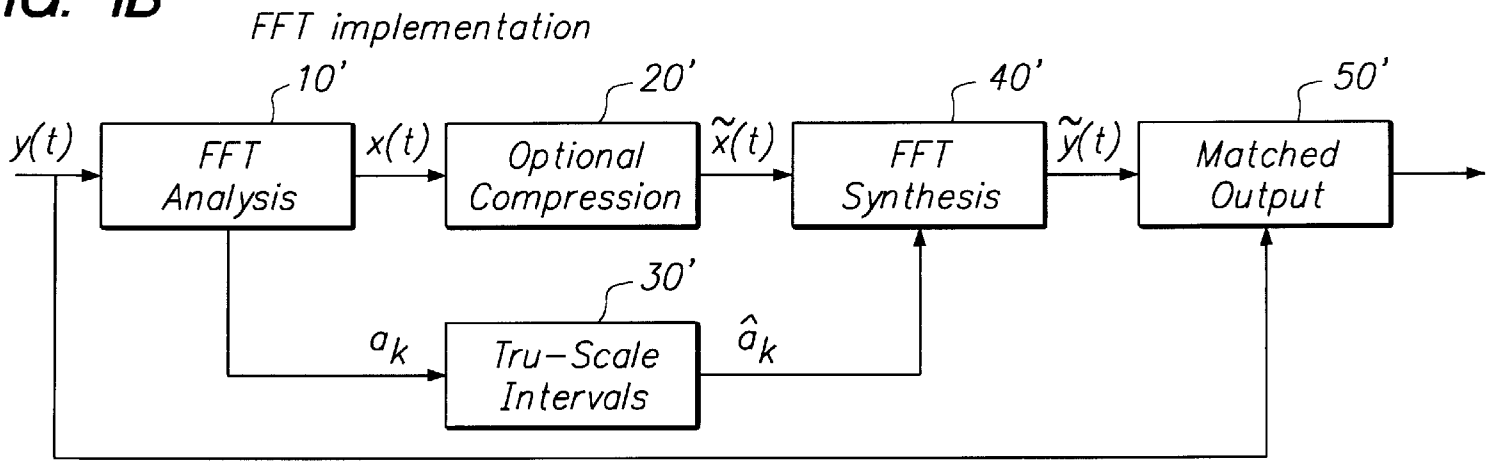
FIG. 1B is a block diagram of an FFT modeling technique according to the invention.

In addition to LPC and other AR techniques, it is possible to use an analysis/synthesis Fourier Transform technique. FIG. 1B schematically depicts the same analysis-synthesis steps as FIG. 1A, with the substitution of "Fourier Transform" for "LPC". The key to use of the Fourier Transform technique is to use a length for the transform that will place the frequency content directly into Tru-Scale intervals during analysis stage 10'. During synthesis stage 40', the resulting signal uses the same Fourier Transform length to reproduce a voice signal that is comprised completely of Tru-Scale frequencies. Using this mechanism, the invention adds the improvement to the signal itself during the analysis-synthesis stage that represents how the vocal tract is modeled.

As with AR modeling techniques, including LPC, hardware and associated software for implementing the necessary Fourier transforms and ascertaining the necessary frequency content of the input speech signal (and then recombine those components) are well known, and so are not described in detail herein. Again, Table I, showing the frequency mappings using Tru-Scale, is what is important to carrying out the invention.

Table I below shows the Tru-Scale pitch assignment with pitch detection accuracy of 0.5 Hz within the octave from 300 to 600 Hz, and a comparison of the internal separation between the frequencies of Tru-Scale as implemented in the present invention and the original input pitch frequencies. While only a subset of frequency mappings are shown, the pattern for continuing the algorithm in either direction (toward a higher or lower frequency) may be seen readily, and suggests applicability of the Tru-Scale system to elimination of noise, interference, etc. in any range of frequencies.

The separation reflected in current pitch detection allows fractional parts of frequencies to be passed on to output. In contrast, the Tru-Scale interval separation provides a system of time-space relationships that allows a frequency to be used with other frequencies in a set interval with no continuous fractional extensions, which are compatible, and thus avoids the distortion caused by all other pitch assignments.

TABLE 1

| Pitch Frequency | Tru-Scale Mapping | Interval |
|---|---|---|
| . . . | . . . | . . . |
| 290.75–296.75 | 293.25 | 6.25 |
| 297–300 | 300 | 6.25 |
| 300–306 | 300 | 12.5 |
| 306.5–318.5 | 312.5 | 12.5 |
| 319–331 | 325 | 12.5 |
| 331.5–343.5 | 337.5 | 12.5 |
| 344–356 | 350 | 12.5 |
| 356.5–368.5 | 362.5 | 12.5 |
| 369–381 | 375 | 12.5 |
| 381.5–393.5 | 387.5 | 12.5 |
| 394–406 | 400 | 12.5 |
| 406.5–418.5 | 412.5 | 12.5 |
| 419–431 | 425 | 12.5 |
| 431.5–443.5 | 437.5 | 12.5 |
| 444–456 | 450 | 12.5 |
| 456.5–468.5 | 462.5 | 12.5 |
| 469–481 | 475 | 12.5 |
| 481.5–493.5 | 487.5 | 12.5 |
| 494–506 | 500 | 12.5 |
| 506.5–518.5 | 512.5 | 12.5 |
| 519–531 | 525 | 12.5 |
| 531.5–543.5 | 537.5 | 12.5 |
| 544–556 | 550 | 12.5 |
| 556.5–568.5 | 562.5 | 12.5 |
| 569–581 | 575 | 12.5 |
| 581.5–593.5 | 587.5 | 12.5 |
| 594–600 | 600 | 12.5 |
| 600–612 | 600 | 25 |
| 613–637 | 625 | 25 |
| 638–662 | 650 | 25 |
| 663–687 | 675 | 25 |
| 688–712 | 700 | 25 |
| . . . | ... | ... |
| 1163–1187 | 1175 | 25 |
| 1188–1200 | 1200 | 25 |
| 1200–1225 | 1200 | 50 |
| 1226–1275 | 1250 | 50 |
| 1276–1325 | 1300 | 50 |
| 1326–1375 | 1350 | 50 |
| 1376–1425 | 1400 | 50 |
| . . . | ... | ... |

For the sake of simplicity, the frequency values in the above table, for the octave from 300 Hz to 600 Hz, are provided at a resolution of 0.5 Hz. For extrapolation to lower frequencies and octaves, the resolution becomes finer, as can be seen from the first couple of entries in the table. As the extrapolation proceeds at higher frequencies and octaves, "gaps" of 1 Hz or more can appear. For frequency values falling in these "gaps," the mapping to Tru-Scale can be to either the lower or the higher value.

Figure 3A:
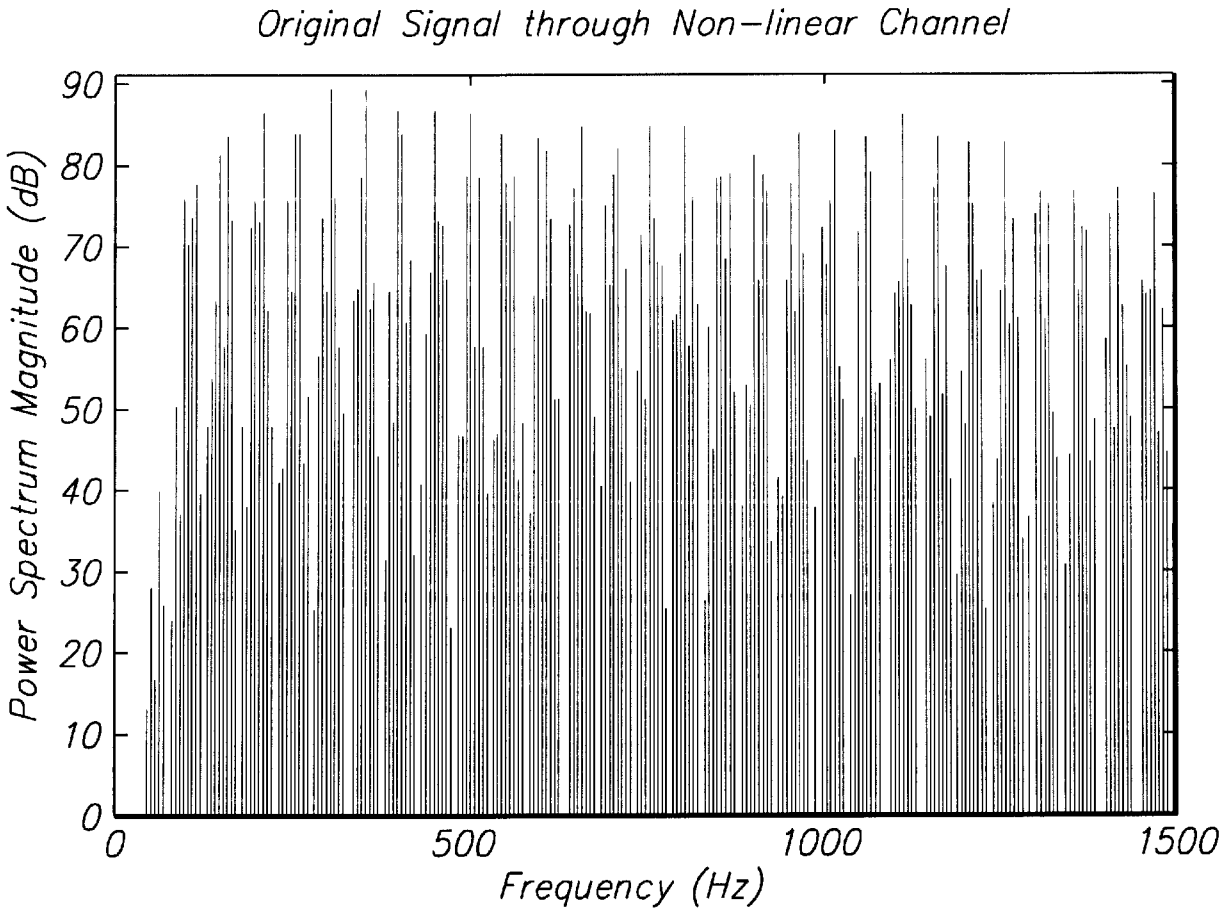
FIG. 3A is the output of a nonlinear system described by the equation $1+x^2+x^3$.

These mathematical data are reaffirmed in the following graphs. Results of employing Tru-Scale processing on a signal can be seen in FIG. 3A and FIG. 3B. FIG. 3A is the power spectrum of a complex signal which has been sent twice through a modeled non-linear channel. The channel is implemented by the following equation:

$$s_{out}=s_{in}+s_{in}^{2}-s_{in}^{3}.$$

Figure 3B:
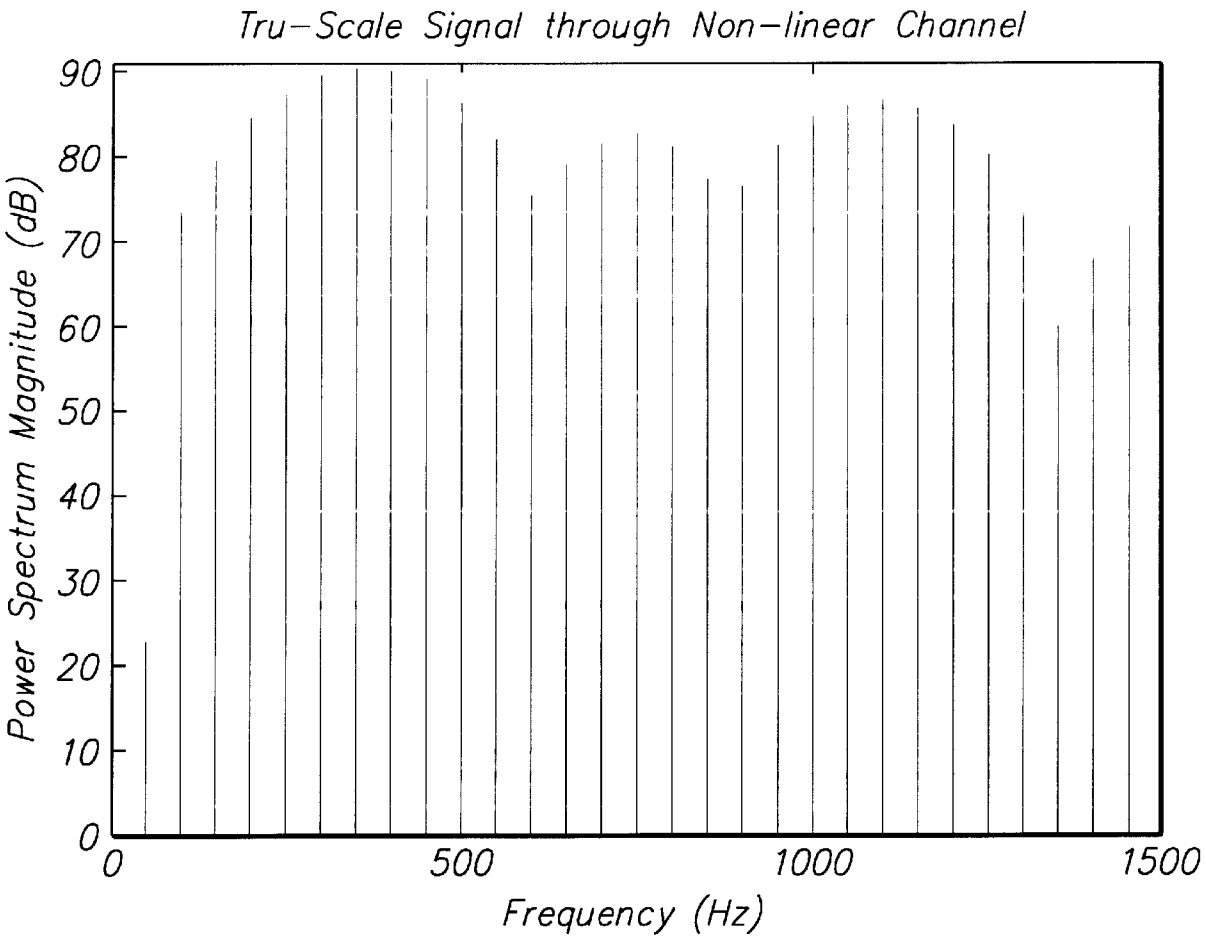
FIG. 3B is the output of the identical system with a signal processed with Tru-Scale.

The signal has been processed twice through the channel with high pass filtering after each stage. The result on the original signal in FIG. 3A is severe harmonic distortions and intermodulation interference hiding the output signal. In FIG. 3B the same signal has been shifted to Tru-Scale frequencies, and then processed the same way as the original through the non-linear system. All harmonics are aligned, therefore reducing the amount of distortion and noise in the signal. The Tru-Scale signal has an increased signal-to-noise ratio and the signal is now easily filtered from the channel noise.

It is well known to those of working skill in the speech processing field that application of frequency transformation to speech signals necessitates further processing to preserve speech formants. Because those processing techniques are well known, they need not be described in detail here. It is noted that one aspect of this post-transformation processing involves compensation for phase velocity, particularly in the case of the Fourier transform implementation. Again, because phase velocity compensation is well known, details need not be provided here.

Figure 4A:
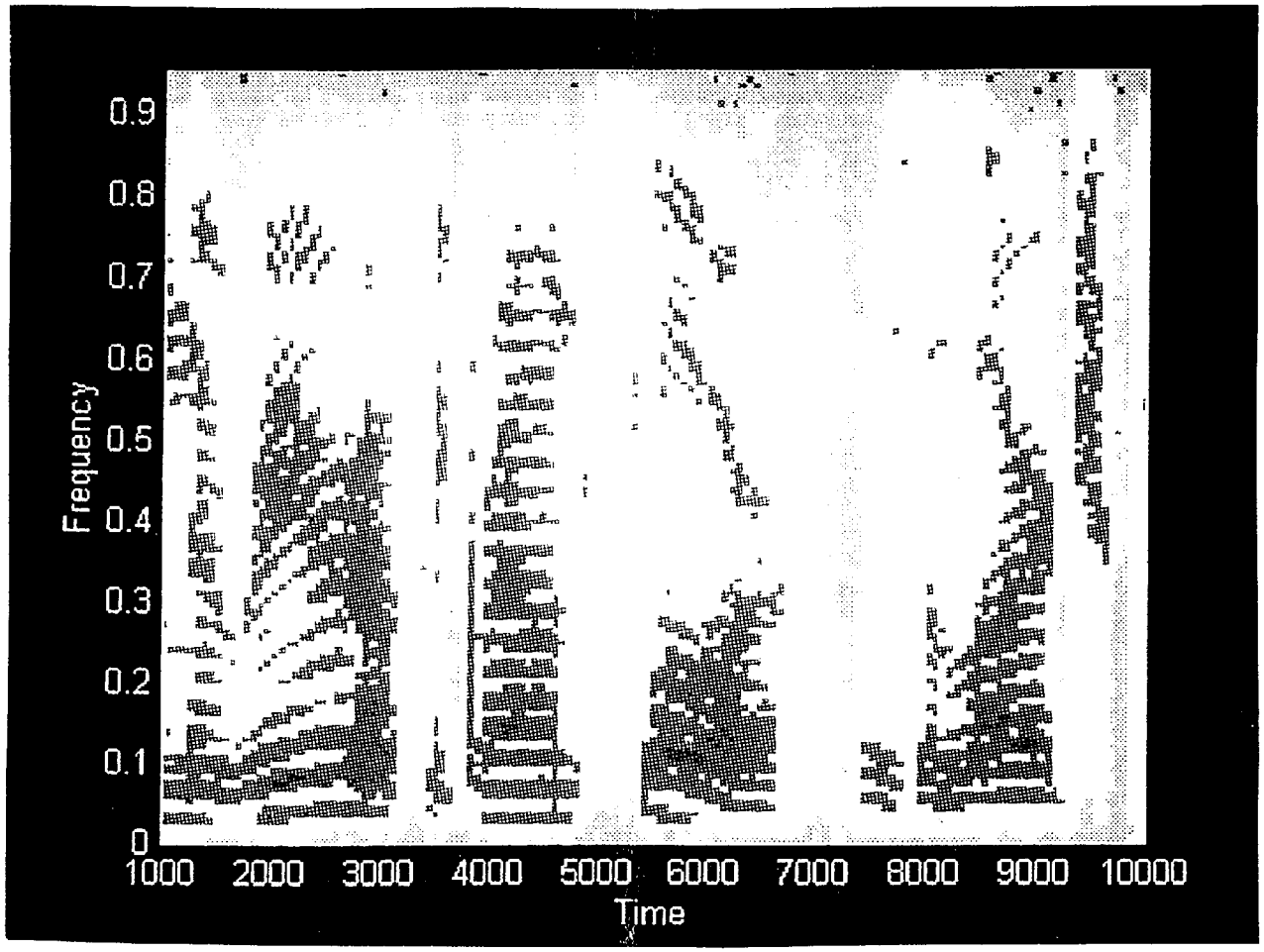
FIG. 4A is a spectrogram figure representing the discrete-time Fourier transform of a speech segment.
Figure 4B:
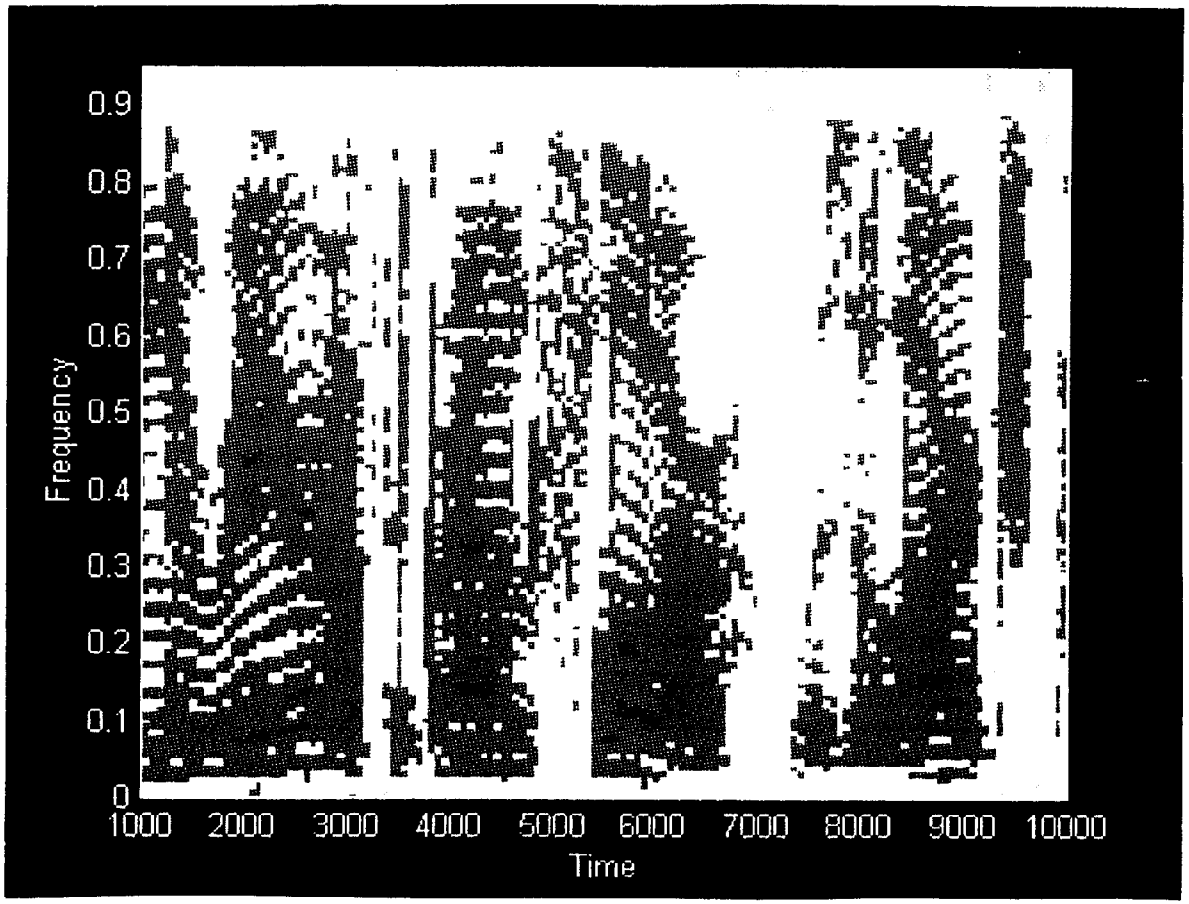
FIG. 4B is the spectrogram of the same speech segment processed with the Tru-Scale AR modeling technique.

Another representation of increased signal to noise ratio can be seen in the spectrogram graphs in FIGS. 4A and 4B. To describe briefly the process of building the graph, first the signal is split into overlapping segments and the window is applied to each segment. Next, the discrete-time Fourier transform of each segment is computed to produce an estimate of the short-term frequency content of the signal. These transforms make up the columns of B. With nfft representing the segment length, the spectrogram is truncated to the first nfft/2+1 points for nfft even and (nfft+1)/2 for nfft odd. For the input speech sequence x and its transformed version X (the Discrete Time FFT equally spaced frequencies around the unit circle), the following relationship is implemented:

$$X(k+1)=x(n+1)W^{kn}{}_{N}$$

The series subscripts begin with 1 instead of 0 because of the vector indexing scheme, and $$W_N=e^{-j(2pi/N)}$$

The input speech signal consists of the spoken words "in the rear of the ground floor." The spectral content of the original signal is represented in FIG. 4A, and the signal processed with Tru-Scale is represented in FIG. 4B. The processed signal has an increased amount of frequency content representation, and therefore a higher signal to noise ratio. This process as used for input into a vocoder would allow the speech signal to be more readily decoded from the transmission noise. Thus, the clarity and quality of the signal, with the increased signal to noise ratio, is apparent.

While the invention has been described in detail with reference to a preferred embodiment, various modifications within the scope and spirit of the invention will be apparent to those of working skill in this technological field. Accordingly, the invention is to be measured by the scope of the appended claims.

What is claimed is:

1. A method of speech processing comprising:

sampling an input speech pattern;

modeling samples of said input speech pattern to obtain equations which constitute a model of said input speech pattern;

shifting coefficients of said equations using a predetermined frequency transformation to provide shifted coefficients; and substituting said shifted coefficients in said equations to provide a transformed speech pattern.

2. A method according to claim 1, wherein said modeling step is performed using an autoregressive technique to obtain said equations which constitute a model of said input speech pattern as a function of time.

3. A method according to claim 2, wherein said autoregressive technique is linear predictive coding (LPC).

4. A method according to claim 2, wherein said autoregressive technique is pronys.

5. A method according to claim 2, wherein said autoregressive technique is mixed excitation linear prediction (MELP).

6. A method according to claim 2, wherein said autoregressive technique is code excited linear prediction (CELP).

7. A method according to claim 2, wherein said autoregressive technique is selected such that said coefficients are calculated to satisfy a maximum likelihood constraint.

8. A method according to claim 1, wherein said step of shifting coefficients is performed by mapping first frequencies, corresponding to voiced speech, to second frequencies in accordance with said predetermined frequency transformation.

9. A method according to claim 1, wherein said step of shifting coefficients is performed so as to preserve formants in said input speech pattern.

10. A method according to claim 1, wherein said step of shifting coefficients is performed so as to compensate for changes in phase velocity.

11. A method according to claim 1, wherein said predetermined frequency transformation is Tru-Scale.

12. A method according to claim 1, further comprising the step of matching an output level of said transformed speech pattern to a level of said input speech pattern.

13. A method according to claim 1, further comprising, prior to said substituting step, imposing a compression technique on said equations to provide compressed equations, said substituting step comprising substituting said shifted coefficients into said compressed equations to provide said transformed speech pattern.

14. A method of speech processing comprising:

sampling an input speech pattern;

modeling samples of said input speech pattern using Fourier transforms to obtain a model of said input speech pattern as a function of frequency; and selecting a length of said Fourier transforms in accordance with a predetermined frequency transformation to provide a transformed speech pattern.

15. A speech processing system comprising:

an analysis section, receiving an input speech pattern, for modeling said input speech by means of equations;

a shift section, connected to said analysis section, for shifting coefficients of said equations according to a predetermined frequency transformation to provide shifted coefficients; and a synthesis section, connected to said shift section, for combining said shifted coefficients into said equations to provide a transformed speech pattern.

16. A system according to claim 15, wherein said analysis section models said input speech using an autoregressive technique such that said equations constitute a model of said input speech as a function of time.

17. A system according to claim 16, wherein said autoregressive technique is selected such that said coefficients are calculated to satisfy a maximum likelihood constraint.

18. A system according to claim 16, wherein said autoregressive technique is linear predictive coding (LPC).

19. A system according to claim 15, wherein said shifting section maps first frequencies, corresponding to voiced speech, to second frequencies in accordance with said predetermined frequency transformation.

20. A system according to claim 19, wherein said predetermined frequency transformation is Tru-Scale.

21. A system according to claim 15, further comprising means for preserving formants in said input speech pattern after said shift section provides said shifted coefficients.

22. A system according to claim 15, further comprising means for compensating for changes in phase velocity resulting from shifting of coefficients in said shift section.

23. A speech processing system comprising:

an analysis section, receiving an input speech pattern, for modeling said input speech using a Fourier transform technique to model said input speech as a function of frequency;

a transform length selection section, connected to said analysis section, for selecting lengths of said Fourier transforms according to a predetermined frequency transformation; and a synthesis section, connected to said transform length selection section, for providing a transformed speech pattern.

* * * * *